US011629871B1

(12) United States Patent
Meyers et al.

(10) Patent No.: US 11,629,871 B1
(45) Date of Patent: Apr. 18, 2023

(54) BIFURCATED AIR TOWER

(71) Applicant: Morgan Stanley Services Group Inc., New York, NY (US)

(72) Inventors: Philip Meyers, North Bellmore, NY (US); James Cullen, Paramus, NJ (US)

(73) Assignee: MORGAN STANLEY SERVICES GROUP INC., New York, NY (US)

( * ) Notice: Subject to any disclaimer, the term of this patent is extended or adjusted under 35 U.S.C. 154(b) by 446 days.

(21) Appl. No.: 16/859,340

(22) Filed: Apr. 27, 2020

(51) Int. Cl.
*F24F 7/06* (2006.01)
*F24F 13/06* (2006.01)

(52) U.S. Cl.
CPC ..... *F24F 7/06* (2013.01); *F24F 13/06* (2013.01); *F24F 2221/40* (2013.01)

(58) Field of Classification Search
CPC .. F24F 7/06; F24F 7/10; F24F 2221/40; F24F 13/06
USPC ..... 454/184–186
See application file for complete search history.

(56) References Cited

U.S. PATENT DOCUMENTS

| | | | | |
|---|---|---|---|---|
| 7,716,939 | B1 * | 5/2010 | Morales | H05K 7/20745 361/688 |
| 9,084,369 | B2 | 7/2015 | Lewis, II et al. | |
| 10,485,142 | B2 | 11/2019 | Rogers | |
| 2005/0011964 | A1 | 1/2005 | Greenlee | |
| 2007/0056304 | A1 | 3/2007 | Everett et al. | |
| 2014/0238639 | A1 | 8/2014 | Ambriz et al. | |

OTHER PUBLICATIONS

Global IFS, Underfloor Air Distribution, globalifs.com, accessed Mar. 12, 2020, 2 pages.
Global IFS, Air Towers, Underfloor Air Distribution, globalifs.com, accessed Mar. 12, 2020, 2 pages.

* cited by examiner

*Primary Examiner* — Vivek K Shirsat
(74) *Attorney, Agent, or Firm* — K&L Gates LLP

(57) ABSTRACT

A UFAD system with bifurcated air towers. The air towers are bifurcated in the sense that the air columns are fan-less and coil-less, and fans for delivering pressurized air to the air columns, and hence to the underfloor plenum of the UFAD system, are in overhead ceiling air ducts and spaced away from the air columns. Cooling coils could be located in a remote air handling unit that feeds conditioned air to the overhead ceiling air ducts to be pressurized by the fans.

19 Claims, 6 Drawing Sheets

BIFURCATED AIR TOWER

BACKGROUND

Underfloor air distribution (UFAD) is an air distribution strategy for providing ventilation and space conditioning in buildings as part of the design of an HVAC system. UFAD systems use an underfloor supply plenum located between the structural concrete slab and a raised floor system to supply conditioned air through floor diffusers directly into the occupied zone of the building. UFAD has several potential advantages over traditional overhead systems, including layout flexibility, improved thermal comfort and ventilation efficiency, reduced energy use in suitable climates, and life-cycle costs. The reduced energy use results primarily from the thermal stratification, which allows higher supply air temperature compared to the traditional overhead systems.

One drawback of UFAD systems is the use of large, floor-space-consuming, and sightline-blocking air towers that deliver pressurized air into the underfloor plenum. FIG. 1 shows a conventional air tower for a UFAD system. It includes internal fans and coils, which consume floor space and block sightlines.

SUMMARY

In one general aspect, the present invention is directed to a UFAD system with so-called "bifurcated air towers." An conventional air tower is composed of a fan and a mixing box, which are used to pressurize and control the air temperature, as well as an air column, which transports the tempered pressurized air from the fan to under the underfloor plenum of the UFAD system. A bifurcated air tower isolates the fan and mixing box from the air column. Hence the air column in a bifurcated air towner is fan-less, so that the fans for delivering tempered, pressurized air can be located in the overhead ceiling and spaced away from the air column. Cooling coils could be located in a remote air handling unit that feeds conditioned air to the overhead ceiling air ducts to be pressurized by the fans.

Bifurcating the fans and coils from the air columns in such a manner provides many benefits in comparison to conventional air towers. For example, bifurcated air towers can be significantly reduced in size relative to conventional air towers. As such, a "bifurcated" air towers consumes less space on the floor level, which additional space could be used for additional desks or workspaces, workplace collaboration spaces, and/or workplace amenities. The reduced-size bifurcated air towers also allow for better sightlines across the floor level. These and other benefits realizable through the present invention will be apparent from the description to follow.

FIGURES

Various embodiments of the present invention are described herein by way of example in conjunction with the following figures, wherein.

DESCRIPTION

Figure 2:
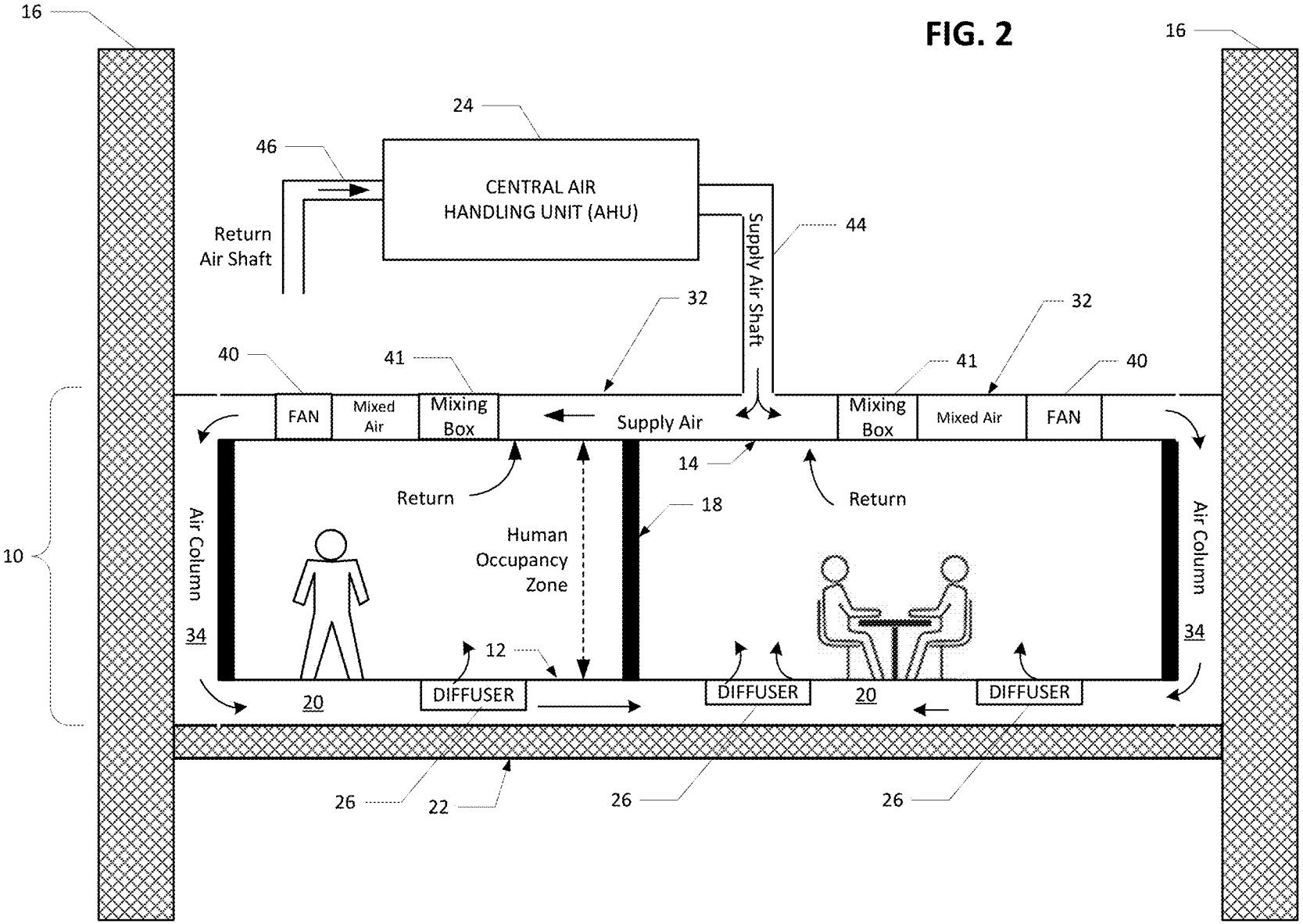
FIG. 2 is a diagram of a single floor of a building with a UFAD system with a bifurcated air tower according to various embodiments of the present invention.

FIG. 2 illustrates a UFAD system for one floor level 10 of a building. Multiple floor levels in the building could have such a UFAD system as described further below. As illustrated in FIG. 2, the human occupancy zone of the floor level 10 extends from the raised floor 12 to the ceiling 14. Building support columns 16 of the building, which support columns 16 could be fabricated from steel or concrete, for example, support a lower floor support structure or solid substrate 22 (e.g., a concrete slab), from which the raised floor 12 is raised. Rooms on the floor level could be separated by walls 18 that extend from the raised floor 12 to the ceiling 14.

As shown in FIG. 2, the UFAD system for the floor level 10 may comprise an underfloor plenum 20 between the raised floor 12 and lower floor support structure 22. The raised floor 12 may be supported above the lower floor support structure 22 by supports or pedestals (not shown) that support the raised floor 12 approximately 12" to 18" above the lower floor support structure 22. Wires and cables for electrical and computer equipped could also be run through the underfloor plenum 20.

As described in more detail below, pressurized, conditioned air from the building's central air handling unit (AHU) 24 is ducted into the underfloor plenum 20, where the conditioned air flows up through diffusers 26 (or other suitable types of supply outlets) at the raised floor 12 and into the human occupancy zone of the floor level 10. In various embodiments, the diffusers 26 may be intelligently controlled to control air delivery from the underfloor plenum 20 into the human occupancy zone to maintain a thermostat set point. Some or all of the diffusers 26 may comprise an upper air outlet grill and a direct drive air valve. The air velocity from any such diffusers 26 could be constant when the valve of the diffuser 26 is open. The diffusers 26 could be round, square, or linear, for example, and could be variable or constant air velocity diffusers.

Figure 1:
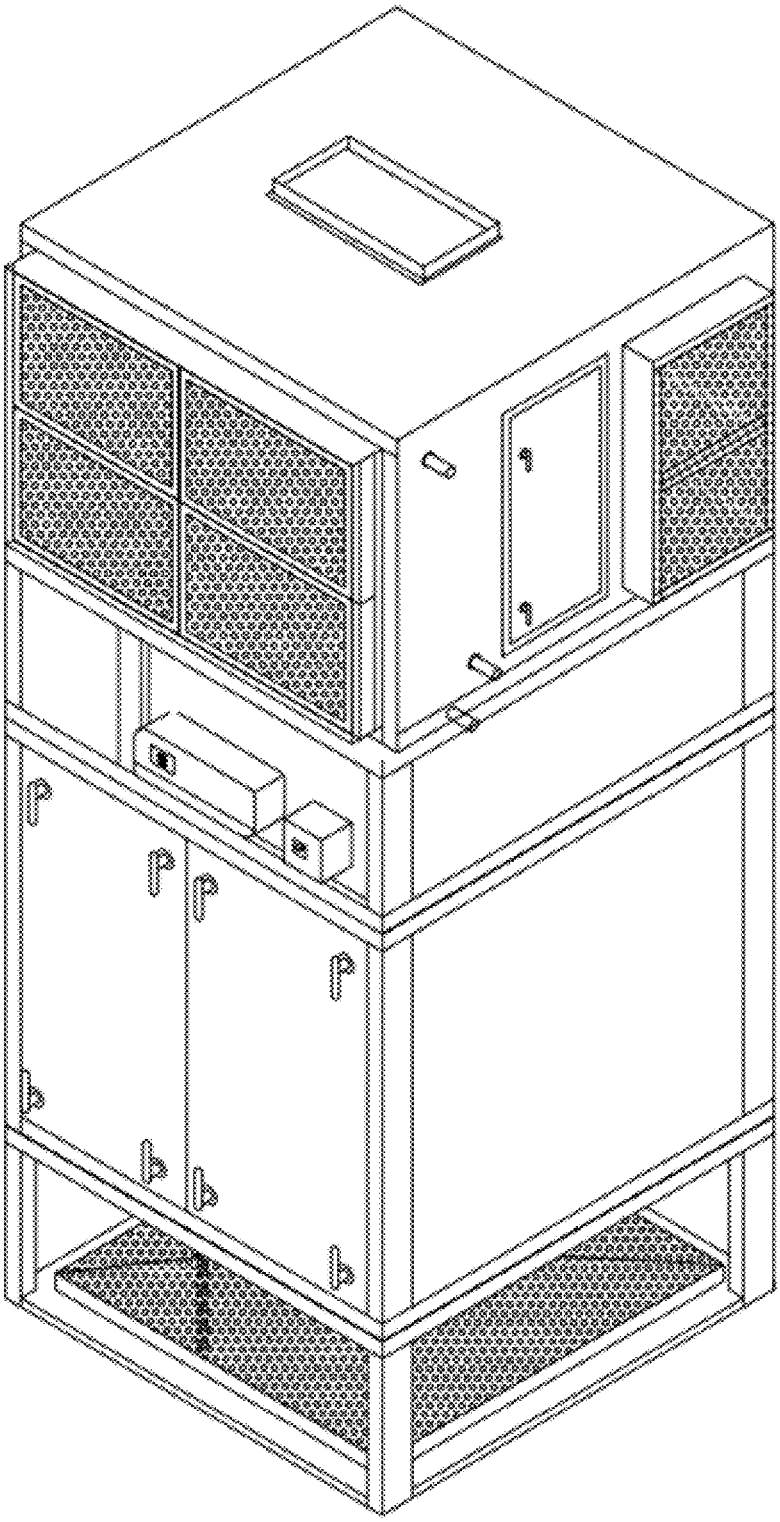
FIG. 1 (Prior Art)
FIG. 1 is diagram of a conventional air tower, which conventional air tower includes space-consuming fans and cooling coils.

Air from the central AHU 24 may be ducted to the underfloor plenum by ducts 44 from the AHU to an over-ceiling duct 32 for the floor level 10, and then via an air column 34 from the over-ceiling duct 32 to the underfloor plenum 20. As shown in FIG. 1, the air columns 34 are preferably located adjacent to or near the support columns 16. Also as shown in FIG. 2, the air columns 34 do not include fans or coils, etc. In that sense, the air columns 34 are fan-less and coil-less air towers. That is because, as shown in FIG. 2, the over-ceiling duct 32 includes ceiling-mounted fans 40 to pressurize the air ducted from the central AHU 24 to the underfloor plenum 20, and the central AHU 24 can comprise coils for cooling and/or conditioning the air. The air in the plenum 20 may be pressurized by the fans 40 at approximately 0.5" of static pressure and may have a temperature of about 60 to 65 degrees Fahrenheit. To that end, the central AHU 24 may include air conditioning and cooling systems such that the central AHU 24 (i) receives the warmed, vented return air via the return air shaft 46, (ii) cools and/or conditions the air, (iii) supplies outside air and (iv) supplies the cooled, conditioned supply air to the underfloor plenum 20 via the supply air shafts 44, the overhead ceiling ducts, and the air columns 34.

The fans 40 may be fan units that comprise a single fan or multiple fans. As shown in FIG. 2, the fans 40 and AHU 24 are separated, or "bifurcated," from the fan-less, coil-less air columns 34. Each air column 34 can have an associated or corresponding fan 40 that delivers pressurized air to the air column 34 via a corresponding, dedicated overhead air duct 32 for the fan 40 and air column 34. Separating the fans and coils from the air columns in such a manner allows the air columns 34 to be significantly reduced in size relative to conventional air towers. As such, the "bifurcated" air towers consume less space on the floor level, which additional space could be used for additional desks or work spaces, workplace collaboration spaces and/or workplace amenities. While the square footage of the penetrations into the raised floor may be comparable for conventional air towers and the bifurcated air towers described herein, conventional air towers would take up more floor space because of the enclosures that need to be built around a conventional air tower. For example, a conventional air tower may be five feet by five feet (in cross-section, e.g., floor penetration), but a conventional air tower typically is housed in a room that is ten feet by ten feet. Also, by separating the fan from the air column according to the presently described bifurcated air towers, a bifurcated air tower would typically consume less prime real estate on the floor since the bifurcated air column could be adjacent to a building support column, thereby consuming less overall space and less prime space.

The reduced-size air columns 34 also allow for better sightlines across the floor level 10. In FIG. 2, the air columns 34 are adjacent to support columns 16 that are at the perimeter of the building. In other embodiments, some or all of the support columns 16, which have adjacent air columns 34, do not need to be at the perimeter of the building or floor. Instead, support columns 16 having an adjacent air column 34 could be in the central portion or core of the floor. A build-out of approximately 2'-3' by 2'-3' adjacent to the support columns 16 may be needed to accommodate the air columns. The air columns 34 may comprise, for example, vertical, rectangular ducts whose perimeter walls could be made of a galvanized steel, for example. The air columns 34 may comprise an upper air inlet for receiving air from the over-ceiling duct 32 and a lower air outlet for throwing pressurized air into the underfloor plenum 20. The outer walls of the air columns are also preferably insulated to prevent condensation and to limit temperature loss of the air through the air column 34.

While having the air column 34 adjacent to the support columns is preferred, in still other implementations, some or all of the air columns 34 do not need to be adjacent to building support columns. To that end, the number of air columns for a floor depends on the area and shape of the raised floor 12. An air column 34 might only be able to "throw" effectively and efficiently air to a diffuser 26 that is at most one hundred feet away, for example, in most cases. Thus, the number and position of air towers on the floor has to be strategically determined so that diffusers 26 in all desired locations of the floor can be reached. In some cases, only using air columns that are adjacent to building support columns 16 may be insufficient to reach diffusers in all corners of the floor, in which case a "stand-alone" air column (i.e., an air tower that is not adjacent to a building support column) may be needed.

Air that is delivered into the human occupancy zone from the underfloor plenum 20 can, after warming, rise to exit the human occupancy zone via air returns 46, typically located near the ceiling 14, such that the return air can be ducted back to the central AHU 24. If the temperature of the air from the central AHU is about 53 to 55 degrees Fahrenheit, for example, the air temperature in the lower 6 to 7 feet of the human occupancy zone should remain comfortable. The central AHU 24 could be located on a different floor of the building, such as a mechanical floor, for example. The supply and return air shafts can carry the supply or return air, as the case may be, vertically from or to the central AHU 24 across multiple floors of the building if necessary.

As shown in FIG. 2, the UFAD system may also include air mixing boxes 41 above the ceiling 14. Vented, return air from the human occupancy zone may enter the mixing boxes 41 via a return air vent in or near the ceiling 14. A portion of the return air is mixed with air from the central AHU 24, with the mixed air being ducted to the fans 40 via the overhead ceiling air duct 32. Another portion (the remaining portion) of the vented air is directed to central AHU 24 via the return air shaft 46 (only one of which is shown in FIG. 2 for simplicity). The air from the central AHU 24 entering the mixing box 41 may be at about 53 to 55 degrees Fahrenheit. The return air vented to the mixing box 41 from the human occupancy zone may be about 75 to 78 degrees Fahrenheit. After mixing by the mixing box 41, the mixed air delivered to the fan 40 (and ultimately to the air columns 34 and underfloor plenum 20) can be about 62 to 65 degrees Fahrenheit. In various embodiments, each air mixing box 41 may comprise multiple dampers. For example, the air mixing boxes 41 may comprise two sets of dampers: one set for the supply air from the central AHU 24; and another set from the return air for mixing the two air streams.

Figure 6:
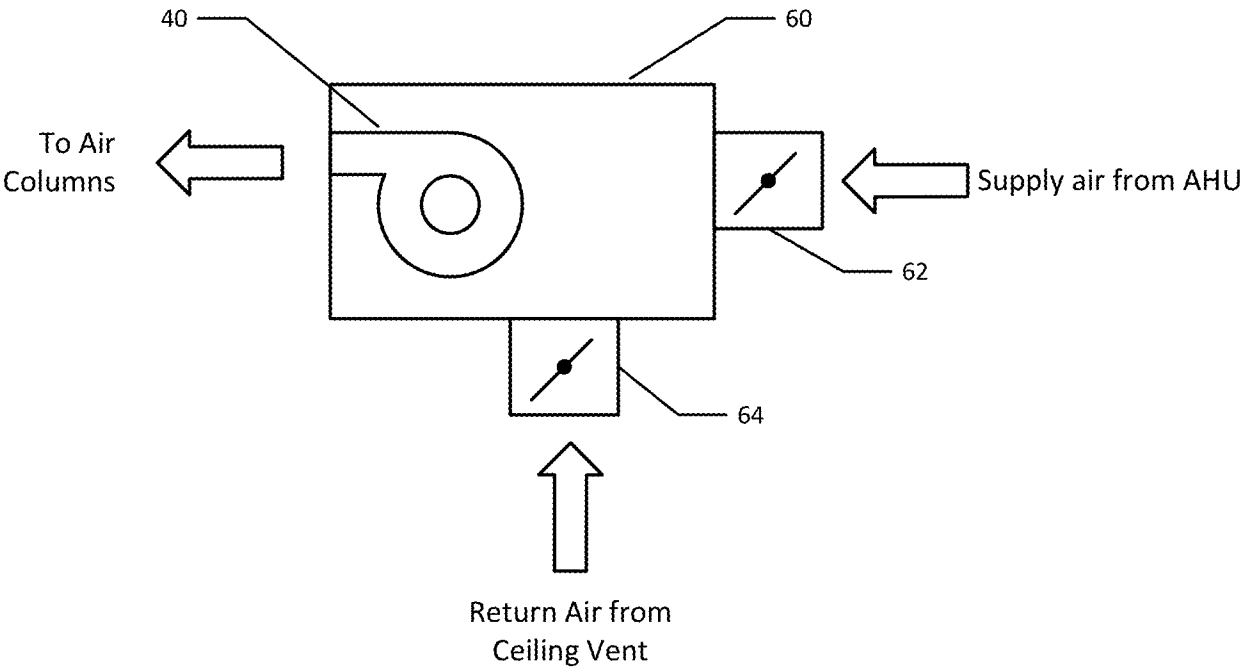
FIG. 6 is a diagram of a fan power box according to various embodiments of the present invention.

In various embodiments, a fan and a mixing box could be integrated into a common unit, such as a fan power box (FPB) 60, such as shown in FIG. 6. A FPB 60 may include the fan 40 and two dampers 62, 64. The first damper 62 regulates air flow from the central AHU 24, i.e., the supply air. The second damper 64 regulates air flow vented from the human occupancy zone via a ceiling vent, for example. The supply and return air can be mixed in the FPB 60, with the pressurized air output from the fan 40 being supplied to an air column(s) 34. The dampers (whether in a FPB 60 or in a separate mixing box 41) could be motorized and controlled by a building management system (not shown).

Figure 3:
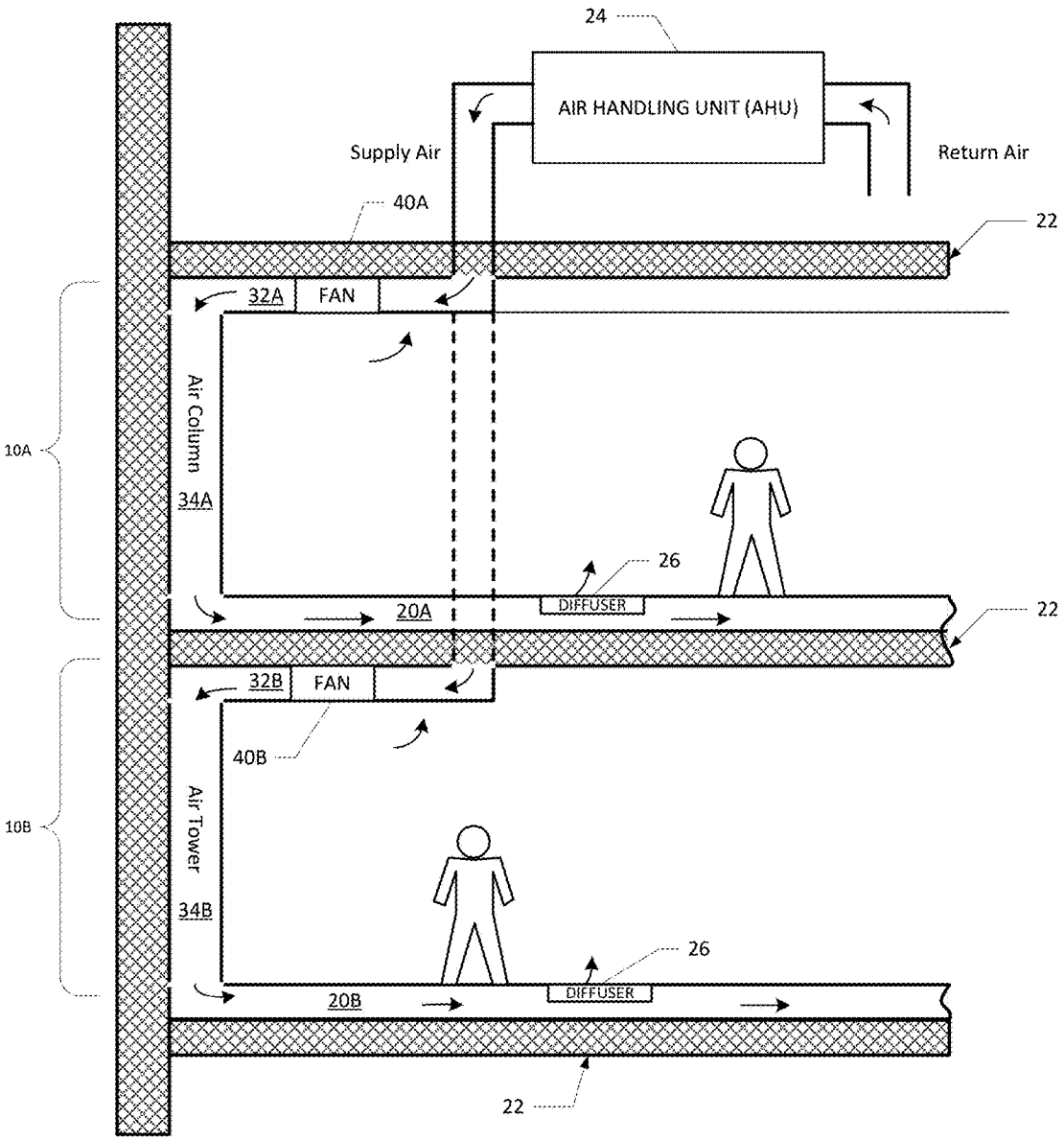
FIG. 3 is a diagram of two adjacent floors of a building with a UFAD system with a bifurcated air tower according to various embodiments of the present invention.

FIG. 2 shows one supply air shaft 44 feeding an overhead ceiling duct 32 that supplies two fans 40 and two air columns 34. In some embodiments, each overhead ceiling air duct 32 could have a separate supply air shaft, a separate (or dedicated) fan 40, a separate (or dedicated) mixing box 41, and a separate (or dedicated) air column 34, such as shown in FIG. 3 (FIG. 3 does not show a mixing box for simplicity; it would be between the fan 40 and supply air shaft). In still other embodiments, one fan unit 40 or a fan array could feed multiple air columns 34. For example, an array of six fans 40 could feed sixteen air columns 34; other arrangements with multiple fans and multiple air columns could also be used.

The UFAD system shown in FIG. 2 could be used on multiple floors in a single building, such as shown in FIG. 3, which shows the UFAD system being used for two adjacent floors 10A, 10B. As shown in FIG. 3, both air columns 34A, 34B are bifurcated in that they are fan-less and/or coil-less, with the over-ceiling ducts 32A, 32B having the fans 40A, 40B and mixing boxes (not shown in FIG. 3), both of which are spaced from the air columns 34A, 34B.

The central AHU 24 can be located on a different floor of the building, such as a mechanical level or floor of a high-rise, multi-story building. The supply air shafts and the return air shafts from and to the central AHU 24 can run to the respective floors 10A, 10B to provide supply air to the floors 10A, 10B and to vent the return air from the floors 10A, 10B.

Figure 4:
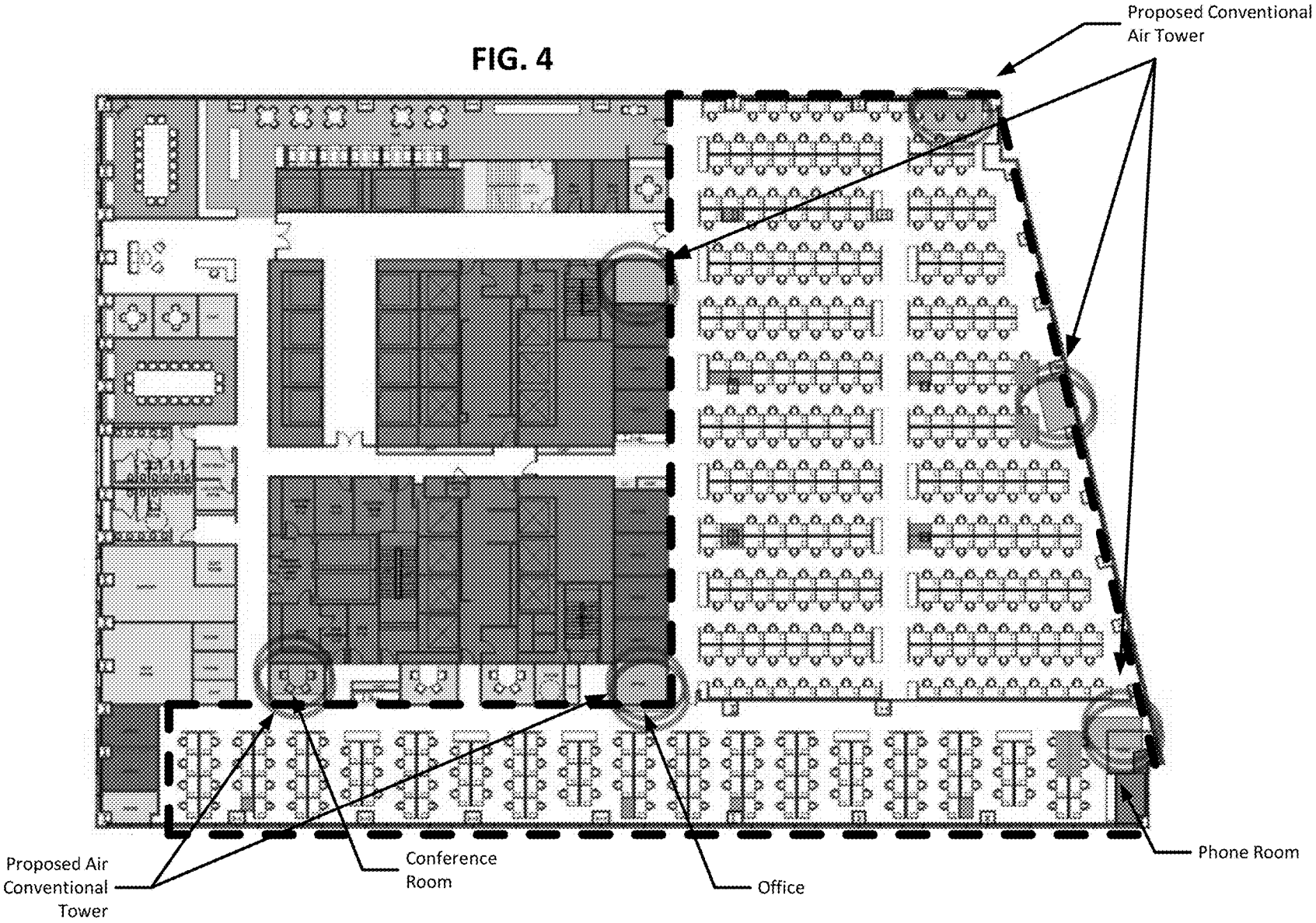
FIG. 4 is a floor plan of for a floor of a building to be retrofit with a UFAD system with conventional air towers.
Figure 5:
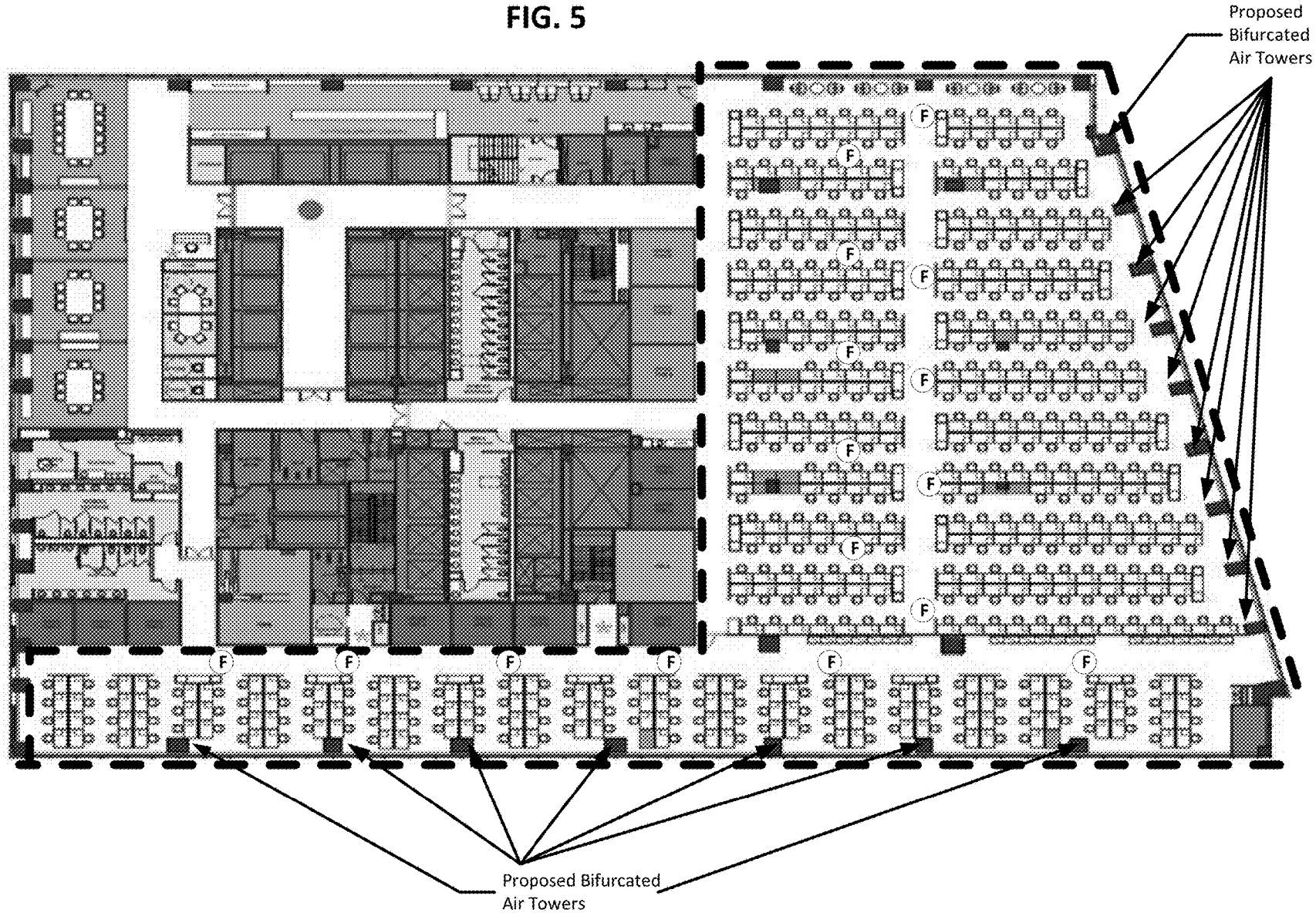
FIG. 5 is a floor plan of for a floor of a building to be retrofit with a UFAD system with bifurcated air tower according to various embodiments of the present invention.

The UFAD systems described herein could be installed as part of an original construction of a building or, in the alternative, one or more floors of an existing building could be retrofit to have a UFAD system as described herein. For example, FIGS. 4 and 5 are top views of an existing floor plan to be retrofitted with a UFAD system. FIG. 4 illustrates the retrofit plan with conventional air towers such as shown in FIG. 1, whereas FIG. 5 illustrates an example retrofit with bifurcated air towers. The floors in FIGS. 4 and 5 include numerous desks at which employees could work, elevators, offices, conference rooms, phone rooms, and community spaces, lavatories, etc., although the raised floor is only for the desk area 100 in this example. The conventional design, shown in FIG. 4, requires five conventional air towers, but "costs" eleven desks, one office, one small conference room, and one phone room. On the other hand, while the retrofit design of FIG. 5 uses sixteen bifurcated air towers, with the sixteen fans and sixteen air columns cumulatively consuming less floor space than the five conventional air towers shown in FIG. 4 since the air columns in FIG. 5 are smaller and adjacent to existing support columns for the building. For example, the air columns in FIG. 5 could have cross-sectional rectangular dimensions of 24" by 10". As a result, the retrofit design of FIG. 5 costs fewer any desks, etc. In the design of FIG. 5, there is a corresponding ceiling 40 for each air column 34. Exemplary locations of the ceiling fans 40 are shown in FIG. 5 by a circled "F" for fan. The fans could be located within approximately 2 to 150 feet of their associated air towers. As explained above, the fans are located in over-ceiling ducts that are coupled to the upper, air inlet-portions of the air columns.

As such, a method of retrofitting a building to install a UFAD as described herein may comprise the steps of installing the raised floor surface 12 above the lower floor support structure 22 of the building, thereby defining the plenum 20 under the raised floor structure 12. The method may also comprise the step of installing the overhead ceiling air duct 32 above the ceiling 14, with the space between the raised floor surface 12 and the ceiling 14 defining a human occupancy space. The method also comprises the step of installing a fan 40 in the overhead ceiling air duct 32, where the fan 40 is for pressurizing air in the overhead ceiling air duct 32. The method also comprises installing the fan-less, coil-less, air column 34 that provides the conduit for pressurized air from the overhead air duct 32 to the plenum 20, where the fan 40 is spaced in the overhead ceiling air duct 32 from its associated air column 34. The method can also comprise the step of installing one or more diffusers 26 at the raised floor level 12 for diffusing pressurized air in the plenum 20 into the human occupancy zone. These steps can be performed in any desired order and some steps could be performed simultaneously.

In the aforementioned embodiments, the central AHU 24 takes the return air from the floor(s) and mixes the return air with outside air for ventilation. The AHU 24 then conditions the air using a coil. In other embodiments, cooling coils could be located next to the fans 40. Locating cooling coils next to the fans 40 can reduce the amount of return air that is returned to the AHU 24, such as in a Dedicated Outdoor Air System (DOAS).

The fan power box (FPB) 60 (see FIG. 6) may comprise a variable air valve to mix the induced air from the ceiling plenum with the supply air. In such a configuration, the bifurcated air tower isolates the FPB 60 from the air column 34. Note that the FPB 60 could include a cooling coil as in a DOAS.

In one general aspect, therefore, the present invention is directed to a UFAD system for a building. The UFAD system comprises, according to various embodiments: a raised floor surface; a ceiling, such that the space between the raised floor surface and the ceiling defines a human occupancy space; a plenum under the raised floor surface; a first overhead ceiling air duct above the ceiling; and a first fan in the first overhead ceiling air duct for pressurizing air in the first overhead ceiling air duct. The UFAD system further comprises a first fan-less, coil-less air column that provides a conduit for pressurized air from the first overhead air duct to the plenum, such that the first fan is spaced in the first overhead ceiling air duct from the first air tower. The UFAD system further comprises at least one diffuser for diffusing pressurized air in the plenum to the human occupancy zone.

In various implementations, the UFAD system further comprises a first air mixing box for mixing supply air and air vented from the human occupancy zone, such that the mixed air from the first air mixing box is connected to the first fan by the first overhead ceiling air duct.

In various implementations, the raised floor surface is raised relative to a lower floor support structure of the building; the lower floor support structure is supported by a first building support column of the building; and the first air tower is adjacent to the first building support column. The UFAD system may further comprise a plurality of pedestals for supporting the raised floor surface above the lower floor support structure.

The UFAD system may further comprise an air handling unit for supplying the supply air to the first air mixing box. The underfloor air distribution system may be on a different floor of the building than the raised floor structure. The air handling unit may be for supplying conditioned air to the first air mixing box.

In various implementations, the UFAD system may further comprise: a second overhead ceiling air duct above the ceiling; a second fan in the second overhead ceiling air duct for pressurizing air in the second overhead ceiling air duct; and a second fan-less, coil-less air column that provides a conduit for pressurized air from the second overhead air duct to the plenum, such that the second fan is spaced in the second overhead ceiling air duct from the first and second air columns. In such an implementation, the raised floor surface may be raised relative to a lower floor support structure of the building; the lower floor support structure may be supported by first and second building support columns of the building; the first air column may be adjacent to the first building support column; and the second air column may be adjacent to the second building support column.

In another general aspect, the present invention is directed to a method for retrofitting a floor of a building with an underfloor air distribution system. The method may comprise the steps of: installing a raised floor surface above a lower floor support structure of the building, thereby defining a plenum under the raised floor structure; installing a first overhead ceiling air duct above a ceiling, such that the space between the raised floor surface and the ceiling defines a human occupancy space; and installing a first fan in the first overhead ceiling air duct, where the first fan is for pressurizing air in the first overhead ceiling air duct. The method may also comprise the step of installing a first fan-less, coil-less air column that provides a conduit for pressurized air from the first overhead air duct to the plenum, where the first fan is spaced in the first overhead ceiling air duct from the first air column. The method may also comprise the step of installing at least one diffuser for diffusing pressurized air in the plenum to the human occupancy zone. These steps may be performed in any suitable order and some steps may be performed concurrently.

In various implementations, the method further comprises installing a first air mixing box in the first overhead ceiling air duct, where the first air mixing box is for mixing supply air and air vented from the human occupancy zone, such that mixed air from the first air mixing box is connected to the first fan by the first overhead ceiling air duct.

The method may also comprise the steps of: installing a second overhead ceiling air duct above the ceiling; installing a second fan in the second overhead ceiling air duct for pressurizing air in the second overhead ceiling air duct; and installing a second fan-less, coil-less air column that provides a conduit for pressurized air from the second overhead air duct to the plenum, where the second fan is spaced in the second overhead ceiling air duct from the first and second air columns.

The examples presented herein are intended to illustrate potential and specific implementations of the present invention. It can be appreciated that the examples are intended primarily for purposes of illustration of the invention for those skilled in the art. No particular aspect or aspects of the examples are necessarily intended to limit the scope of the present invention. Further, it is to be understood that the figures and descriptions of the present invention have been simplified to illustrate elements that are relevant for a clear understanding of the present invention, while eliminating, for purposes of clarity, other elements. While various embodiments have been described herein, it should be apparent that various modifications, alterations, and adaptations to those embodiments may occur to persons skilled in the art with attainment of at least some of the advantages. The disclosed embodiments are therefore intended to include all such modifications, alterations, and adaptations without departing from the scope of the embodiments as set forth herein.

What is claimed is:

1. An underfloor air distribution system for a building, the underfloor air distribution system comprising:

a raised floor surface;

a ceiling, wherein a space between the raised floor surface and the ceiling defines a human occupancy space;

a plenum under the raised floor surface;

a first overhead ceiling air duct above the ceiling;

a first fan-less, coil-less air column that provides a conduit for pressurized air from the first overhead ceiling air duct to the plenum;

a first fan in the first overhead ceiling air duct, wherein the first fan is configured to pressurize air in the first overhead ceiling air duct, and wherein the first fan is spaced in the first overhead ceiling air duct from the first air column;

a second fan-less, coil-less air column that provides for pressurized air to the plenum;

a second fan for pressurizing air received by the second air column, wherein the second fan is spaced separate from the second air column; and at least one diffuser for diffusing pressurized air in the plenum to the human occupancy space.

2. The underfloor air distribution system of claim 1, further comprising a first air mixing box for mixing supply air and air vented from the human occupancy space.

3. The underfloor air distribution system of claim 2, wherein the first air mixing box and the first fan are part of a fan power box.

4. The underfloor air distribution system of claim 2, wherein:

the raised floor surface is raised relative to a lower floor support structure of the building;

the lower floor support structure is supported by a first building support column of the building; and the first air column is adjacent to the first building support column.

5. The underfloor air distribution system of claim 4, further comprising an air handling unit for supplying the supply air to the first air mixing box.

6. The underfloor air distribution system of claim 5, wherein the air handling unit is on a different floor of the building than the raised floor surface.

7. The underfloor air distribution system of claim 6, further comprising a plurality of pedestals for supporting the raised floor surface above the lower floor support structure.

8. The underfloor air distribution system of claim 6, wherein the air handling unit is for supplying conditioned air to the first air mixing box.

9. The underfloor air distribution system of claim 1, further comprising:

a second overhead ceiling air duct above the ceiling;

the second fan in the second overhead ceiling air duct for pressurizing air in the second overhead ceiling air duct; and the second air column that provides a conduit for pressurized air from the second overhead ceiling air duct to the plenum, wherein the second fan is spaced in the second overhead ceiling air duct from the first and second air columns.

10. The underfloor air distribution system of claim 1, wherein:

the raised floor surface is raised relative to a lower floor support structure of the building;

the lower floor support structure is supported by first and second building support columns of the building;

the first air column is adjacent to the first building support column; and the second air column is adjacent to the second building support column.

11. The underfloor air distribution system of claim 9, further comprising an air handling unit for supplying air to the first and second overhead ceiling air ducts.

12. The underfloor air distribution system of claim 11, wherein the air handling unit is on a different floor of the building than the raised floor surface.

13. The underfloor air distribution system of claim 12, wherein the air handling unit is for supplying conditioned air to the first and second overhead ceiling air ducts.

14. A method of retrofitting a floor of a building with an underfloor air distribution system, the method comprising:

installing a raised floor surface above a lower floor support structure of the building, thereby defining a plenum under the raised floor surface;

installing a first overhead ceiling air duct above a ceiling, such that a space between the raised floor surface and the ceiling defines a human occupancy space;

installing a first fan-less, coil-less air column that provides a conduit for pressurized air from the first overhead ceiling air duct to the plenum;

installing a first fan in the first overhead ceiling air duct, wherein the first fan is configured to pressurize air in the first overhead ceiling air duct, and wherein the first fan is spaced in the first overhead ceiling air duct from the first air column;

installing a second fan-less, coil-less air column that provides for pressurized air to the plenum;

installing a second fan for pressurizing air received by the second fan-less, coil-less air column, wherein the second fan is spaced separate from the second air column; and installing at least one diffuser for diffusing pressurized air in the plenum to the human occupancy space.

15. The method of claim 14, further comprising installing a first air mixing box in the first overhead ceiling air duct, wherein the first air mixing box is for mixing supply air and air vented from the human occupancy space, wherein mixed air from the first air mixing box is connected to the first fan by the first overhead ceiling air duct.

16. The method of claim 14, wherein:

the first fan is part of a fan power box that additionally comprises a first air mixing box; and installing the first fan comprises installing the fan power box.

17. The method of claim 14, wherein:

the raised floor surface is raised relative to a lower floor support structure of the building;

the lower floor support structure is supported by a first building support column of the building; and the first air column is installed adjacent to the first building support column.

18. The method of claim 14, further comprising:

installing a second overhead ceiling air duct above the ceiling;

installing the second fan in the second overhead ceiling air duct for pressurizing air in the second overhead ceiling air duct; and installing the second fan-less, coil-less air column that provides a conduit for pressurized air from the second overhead ceiling air duct to the plenum, wherein the second fan is spaced in the second overhead ceiling air duct from the first and second air columns.

19. The method of claim 14, wherein:

the raised floor surface is raised relative to a lower floor support structure of the building;

the lower floor support structure is supported by first and second building support columns of the building;

the first air column is installed adjacent to the first building support column; and the second air column is installed adjacent to the second building support column.

* * * * *